US007922515B2

(12) United States Patent
Fitzpatrick et al.

(10) Patent No.: US 7,922,515 B2
(45) **Date of Patent: *Apr. 12, 2011**

(54) DEVICES FOR CONNECTING CONDUCTORS OF TWISTED PAIR CABLE TO INSULATION DISPLACEMENT CONTACTS

(75) Inventors: Brian Fitzpatrick, McKinney, TX (US); William Andrew Gordon, Allen, TX (US); Timothy C. Miller, McKinney, TX (US)

(73) Assignee: CommScope, Inc of North Carolina, Hickory, NC (US)

( * ) Notice: Subject to any disclaimer, the term of this patent is extended or adjusted under 35 U.S.C. 154(b) by 124 days.

This patent is subject to a terminal disclaimer.

(21) Appl. No.: 12/429,480

(22) Filed: Apr. 24, 2009

(65) Prior Publication Data

US 2009/0239423 A1 Sep. 24, 2009

Related U.S. Application Data

(63) Continuation-in-part of application No. 11/927,858, filed on Oct. 30, 2007, now Pat. No. 7,568,937.

(51) Int. Cl.
*H01R 4/24* (2006.01)

(52) U.S. Cl. ..... 439/404; 439/395

(58) Field of Classification Search ..... 439/404, 439/405, 403, 395, 397

See application file for complete search history.

(56) References Cited

U.S. PATENT DOCUMENTS 1,883,269 A 9/1928 Yonkers
3,459,878 A 8/1969 Gressitt et al.
4,764,124 A 8/1988 Simon
4,929,190 A 5/1990 Gonon et al.
5,601,447 A 2/1997 Reed et al.
5,624,274 A 4/1997 Lin (Continued)

FOREIGN PATENT DOCUMENTS

CA 2 429 765 A1 11/2004

(Continued)

OTHER PUBLICATIONS

PCT International Search Report and Written Opinion for PCT/US2006/045759; mailed Apr. 4, 2007.

(Continued)

*Primary Examiner* — Tho D Ta
*Assistant Examiner* — Travis Chambers
(74) *Attorney, Agent, or Firm* — Myers Bigel Sibley & Sajovec

(57) ABSTRACT

A termination device to facilitate interconnection of a twisted pair communications cable to IDCs includes: a housing having an aperture and a pair of first and second IDCs extending within the aperture; a twisted pair communications cable having a twisted pair of first and second conductors; and a termination device. The termination device comprises: a body having an outer surface; a channel in the outer surface of the body, the channel being sized and configured to receive a twist of the first and second conductors and to maintain the twist in position; and IDC guide structure configured to guide the first IDC into engagement with the first conductor at a first engagement location and the second IDC into engagement with the second conductor at a second engagement location, the first and second engagement locations being positioned within the channel and within the twist of the first and second conductors. A splitting structure is positioned in the channel that separates at least a portion of the first and second conductors as they reside in the channel.

19 Claims, 9 Drawing Sheets

U.S. PATENT DOCUMENTS

| | | | |
|---|---|---|---|
| 5,803,770 | A | 9/1998 | Swendson et al. |
| 5,871,378 | A | 2/1999 | Poiraud et al. |
| 5,947,761 | A | 9/1999 | Pepe |
| 6,264,496 | B1 | 7/2001 | Robertson et al. |
| 6,267,617 | B1 | 7/2001 | Nozick |
| 6,302,699 | B1 | 10/2001 | Conorich et al. |
| 6,315,596 | B1 | 11/2001 | Chen |
| 6,383,013 | B1 | 5/2002 | Ghesla et al. |
| 6,488,525 | B2 | 12/2002 | Abel et al. |
| 6,565,375 | B1 | 5/2003 | Daoud et al. |
| 6,592,396 | B2 | 7/2003 | Pepe et al. |
| 6,746,283 | B2 | 6/2004 | Arnett et al. |
| 6,752,647 | B1 | 6/2004 | Lin |
| 6,767,241 | B1 | 7/2004 | Abel et al. |
| 6,830,488 | B2 | 12/2004 | Bush et al. |
| 6,953,362 | B2 | 10/2005 | Mössner et al. |
| 7,025,621 | B2 | 4/2006 | Mössner et al. |
| 7,341,474 | B2 | 3/2008 | Clem |
| 7,568,937 | B2 * | 8/2009 | Fitzpatrick et al. ..... 439/404 |
| 2005/0159036 | A1 | 7/2005 | Caveney et al. |

FOREIGN PATENT DOCUMENTS

| | | | |
|---|---|---|---|
| EP | 0 899 827 | A2 | 3/1999 |
| EP | 0 899 827 | A3 | 3/1999 |
| EP | 0 982 815 | A2 | 3/2000 |
| JP | 2004-319207 | | 11/2004 |

OTHER PUBLICATIONS

PCT International Search Report and Written Opinion for PCT/US2008/012167, mailed Apr. 9, 2009.

PCT Partial International Search for PCT/US2010/031829 mailed Aug. 16, 2010.

* cited by examiner

DEVICES FOR CONNECTING CONDUCTORS OF TWISTED PAIR CABLE TO INSULATION DISPLACEMENT CONTACTS

RELATED APPLICATION

This application is a continuation-in-part of U.S. patent application Ser. No. 11/927,858, filed Oct. 30, 2007 now U.S. Pat. No. 7,568,937, the disclosure of which is hereby incorporated herein in its entirety.

FIELD OF THE INVENTION

The present invention generally relates to connecting twisted conductor pairs of a communications connector.

BACKGROUND OF THE INVENTION

As is known, communications patch panels frequently incorporate the use of jack modules, like that shown at 100 in FIG. 1, that can be readily attached to and removed from the patch panel. Typically, existing jack modules 100 include a housing 102 having a front portion 104 and a back portion 110. The front portion 104 is visible to the user of the patch panel and includes one or more jack openings 106 configured to receive a communication connector (not shown). The front and back portions 104, 110 engage and mate with each other and serve to protect internal components, such as a printed wiring board 130, one or more jack receptacles 136, and/or a plurality of insulation displacement connectors (IDCs) 138. The jack receptacles 136 are mounted to the front side 132 of the printed wiring board 130, while the IDCs 138 are mounted to the back side 134. Traces (not shown) on the printed wiring board 130 electrically connect the IDCs 138 to electrical contacts 137 (see FIG. 2) housed within the jack receptacles 136. As assembled, each jack receptacle 136 aligns with a jack opening 106 in the front portion 104 of the housing 102, and the IDCs 138 are aligned with a terminal connection region 112 disposed on the back portion 110. As shown, the front portion 104 and the back portion 110 of the housing are secured together with assembly tabs 108 on the front portion 104 that engage assembly notches 109 on the back portion 110.

FIG. 2 illustrates the jack module 100 as it would be seen by a user of a typical communications patch panel. FIGS. 3 and 4 show the terminal connection region 112 in greater detail. As shown in FIG. 4, the terminal connection region 112 includes two substantially parallel rows 114 of alternating wire guide posts 116 and wire guide splitters 117. As best seen in FIG. 3, adjacent wire guide posts 116 and wire guide splitters 117 have a terminal slot 118 disposed therebetween. Each terminal slot 118 provides access to one of the IDCs 138 disposed within the parallel rows 114. Physical and electrical contact is made between a conductor (not shown) and an IDC 138 by urging the conductor into the terminal slot 118 until the conductor passes between the opposed prongs 139 of the IDC (FIG. 1). Opposed portions of the prongs 139 cut through insulation disposed around the conductor, thereby making electrical contact.

To electrically connect a cable including a plurality of twisted pairs to an existing jack module 100, first a technician determines which IDCs 138 are associated with the desired jack receptacle 136 (see FIGS. 1 and 4). In FIG. 1, the IDCs of interest are accessed by way of the pairs of terminal slots labeled 118*a*, 118*b*, 118*c*, and 118*d*, each of the pairs of the terminal slots 118 being configured to receive the conductors from one of the cable's twisted conductor pairs. Once the desired IDCs 138 have been determined, the technician urges the desired conductor into the appropriate IDC, typically using a device such as a punch-down tool. As shown, one twisted pair would be inserted into each pair of terminal slots 118*a*-118*d*. The wire guide splitters 117 assist the technician in separating the conductors of each twisted conductor pair, thereby making it easier for the technician to insert the desired conductor into the desired IDC 138.

Until recently, such methods of routing twisted pairs on the back of existing jack modules 100 were adequate for existing performance levels. This was because in the past variation of the routing of twisted pairs, from pair to pair, had little effect, if any, on performance. However, recent developments, such as patch panels requiring category 6 performance levels, are much more sensitive to variations in twisted pair termination and routing. One approach to reducing variation in termination and routing is illustrated in U.S. Pat. No. 6,767,241 to Abel et al., the disclosure of which is hereby incorporated herein in its entirety. This patent discusses a termination cap that receives the conductors from the cable, then routes the conductors through apertures and slots in the cap in an organized fashion. The cap is attached to the back portion of the jack module, at which time the organized conductors can be routed to their respective IDCs. Another proposed solution is discussed in U.S. patent application Ser. No. 11/360,733; filed Feb. 23, 2006 and entitled Device for Managing Termination of Conductors with Jack Modules, the disclosure of which is hereby incorporated herein by reference. The device discussed therein includes a block with upper and lower surfaces, first and second opposing end walls that define a longitudinal axis, and first and second opposing side walls. The block further includes two apertures extending from the upper surface toward the lower surface, the apertures being sized and configured to receive each of the plurality of twisted pairs of a cable. Each of the side walls includes at least one open-ended slot opening downwardly, the slots being sized and configured to receive a respective twisted pair of conductors and hold them in place. From there the conductors can be punched into place with a punch tool to connect to the IDCs of a terminal connection region.

Although these solutions are adequate, it may in some instances be desirable to provide even more control of the positions of the conductors in order to further reduce variation in their seating with the IDCs, which in turn can improve electrical performance and reliability. It may also be desirable to simplify the interconnection process between the cable and the IDCs.

SUMMARY OF THE INVENTION

As a first aspect, embodiments of the present invention are directed to a termination device to facilitate interconnection of a twisted pair communications cable to IDCs. The interconnection junction comprises: a housing having an aperture and a pair of first and second IDCs extending within the aperture; a twisted pair communications cable having a twisted pair of first and second conductors; and a termination device. The termination device comprises: a body having an outer surface; a channel in the outer surface of the body, the channel being sized and configured to receive a twist of the first and second conductors and to maintain the twist in position; and IDC guide structure configured to guide the first IDC into engagement with the first conductor at a first engagement location and the second IDC into engagement with the second conductor at a second engagement location, the first and second engagement locations being positioned within the channel and within the twist of the first and second conductors. A splitting structure is positioned in the channel that separates at least a portion of the first and second conductors as they reside in the channel.

As a second aspect, embodiments of the present invention are directed to a method of interconnecting a twisted pair communications cable with a communications connector having a pair of insulation displacement contacts (IDCs), comprising: (a) positioning a twist of a twisted pair conductors of a communications cable in a channel in a termination device; then (b) inserting the termination device into a housing having an aperture and a pair of IDCs extending into the aperture, and (c) imparting relative movement between the termination device and the housing such that a first of the pair of IDCs engages a first conductor of the twisted pair at a first engagement location and a second of the pair of IDCs engages a second conductor of the twisted pair at a second engagement location, the first and second engagement locations being positioned within the twist of the twisted pair. A splitting structure is positioned to separate the conductors of the twisted pair within the twist.

As a third aspect, embodiments of the present invention are directed to an interconnection junction between a twisted pair communications cable and a communications connector having a plurality of insulation displacement contacts (IDCs), comprising: a housing having an aperture and a pair of first and second IDCs extending within the aperture; a twisted pair communications cable having a twisted pair of first and second conductors; and a termination device inserted into the aperture configured to receive and maintain a twist of the twisted pair. The first and second conductors engage, respectively, the first and second IDCs within the twist. The first and second conductors are separated from each other within the twist by a splitting structure.

As a fourth aspect, embodiments of the present invention are directed to a method of connecting the conductors of a twisted pair communications cable having a twisted pair of first and second conductors with a termination device that includes first and second members and a plurality of insulation displacement contacts (IDCs), the method comprising: (a) positioning each conductor on the first member of the termination device; and (b) rotating one of the first and second members relative to the other of the first and second members to cause each IDC to engage and make electrical contact with a respective one of the conductors within a twist of the first and second conductors, wherein a splitting structure separates the first and second conductors as they reside within the twist.

DETAILED DESCRIPTION OF EMBODIMENTS OF THE INVENTION

Figure 1:
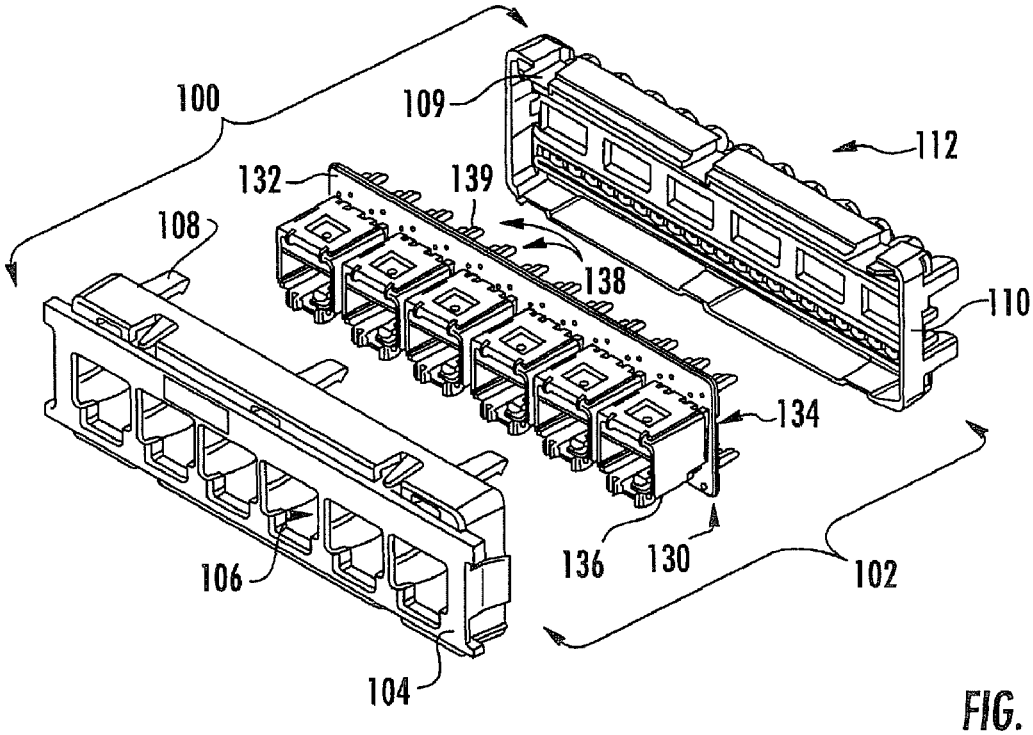
FIG. 1 (PRIOR ART)
FIG. 1 is an exploded, perspective view of a prior art jack module.
Figure 2:
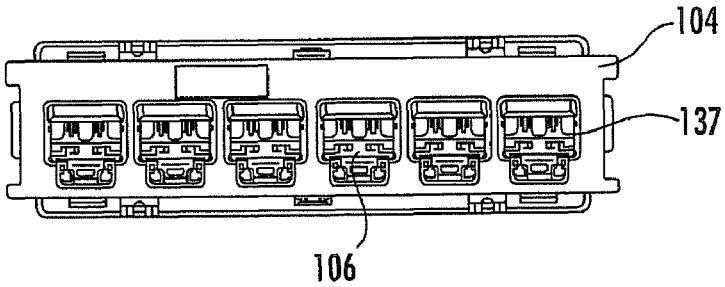
FIG. 2 (PRIOR ART)
FIG. 2 is a front elevational view of the jack module as shown in FIG. 1.
Figure 3:
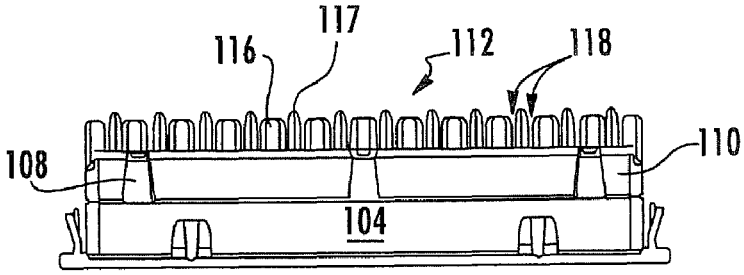
FIG. 3 (PRIOR ART)
FIG. 3 is a top view of the jack module as shown in FIG. 1

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" or "above" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a" "an" and "the" are intended to include the plural forms as well, unless the context clearly indicates otherwise. It will be further understood that the terms "comprises" and/or "comprising," when used in this specification, specify the presence of stated features, integers, steps, operations, elements, and/ or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "mounted" and the like can mean either direct or indirect attachment or contact between elements, unless stated otherwise.

Figure 5:
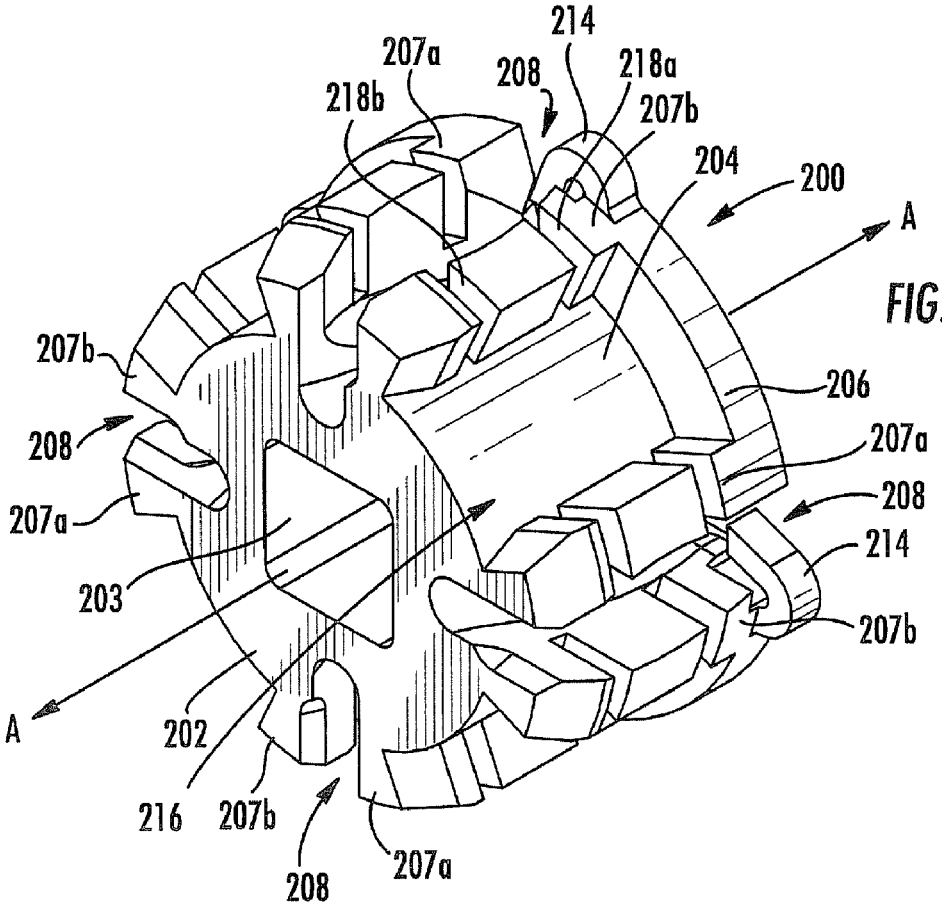
FIG. 5 is a perspective view of a terminating device according to embodiments of the present invention.
Figure 6:
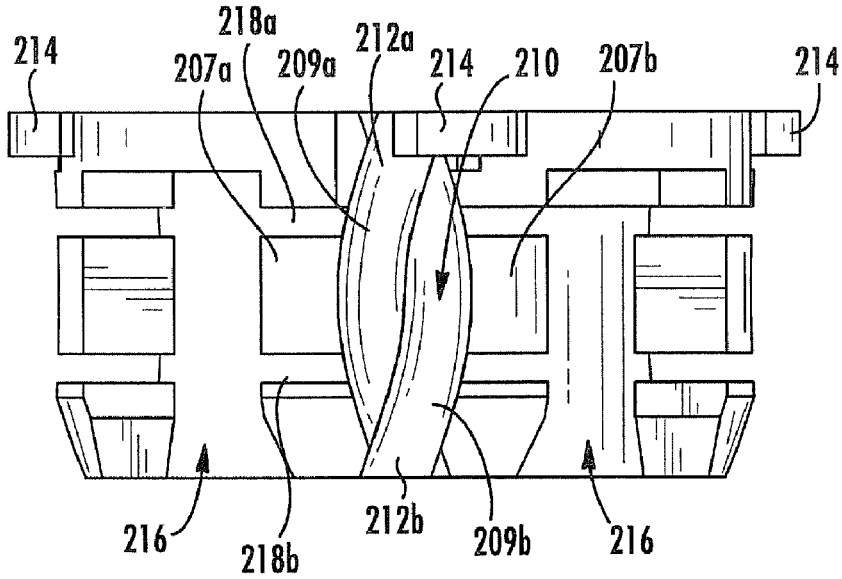
FIG. 6 is a top view of the device of FIG. 5.

Referring now to the figures, a termination device, designated broadly at 200, is illustrated in FIGS. 5 and 6. The device 200 includes a body 202 that is generally cylindrical and defined by an outer wall 204. A circumferential flange 206 extends from one end of the body 202. Also, a central bore 203, shown herein as being generally square, extends along the longitudinal axis A of the body 202.

Referring again to FIGS. 5 and 6, four pairs of channel walls 207*a*, 207*b* extend radially outwardly from the body 202. Each pair of channel walls 207*a*, 207*b* lines a respective open-ended channel 208 that extends generally parallel to the longitudinal axis A and recedes radially inwardly into the body 202. The channels 208 are generally spaced circumferentially equidistant from each other (i.e., in this embodiment having four channels 208, the channels 208 are spaced approximately 90 degrees from each other about the longitudinal axis of the body 202). The channel walls 207*a*, 207*b* and the channel 208 are shaped such that at each end the channel 208 has a respective narrow necked portion 212*a*, 212*b*, and at its center the channel 208 has an expanded portion 210. Also, the floor of the channel 208 has curved indentations 209*a*, 209*b* that are arcuate in cross-section. A looped hook 214 is positioned over the necked portion 212*a*. In some embodiments, the channel 208 is between about 0.230 and 0.270 inches in length and/or between about 0.125 and 0.145 inches in depth, with the necked portions 212*a*, 212*b* being between about 0.043 and 0.053 inches in width and the expanded portion 210 being between about 0.087 and 0.097 inches in width.

Referring still to FIGS. 5 and 6, the channel walls 207*a*, 207*b* between adjacent channels 208 form pockets 216 that are open on one end (the other end being closed by the flange 206). Two circumferentially-extending blade slots 218*a*, 218*b* are located in the channel walls 207*a*, 207*b* near the necked portions 212*a*, 212*b*, the slots 218*a*, 218*b* being generally normal relative to the longitudinal axis A.

In the illustrated embodiment, the device 200 is formed as a unitary member. In some embodiments, the device is formed of a polymeric material, such as polycarbonate or ABS.

Figure 7:
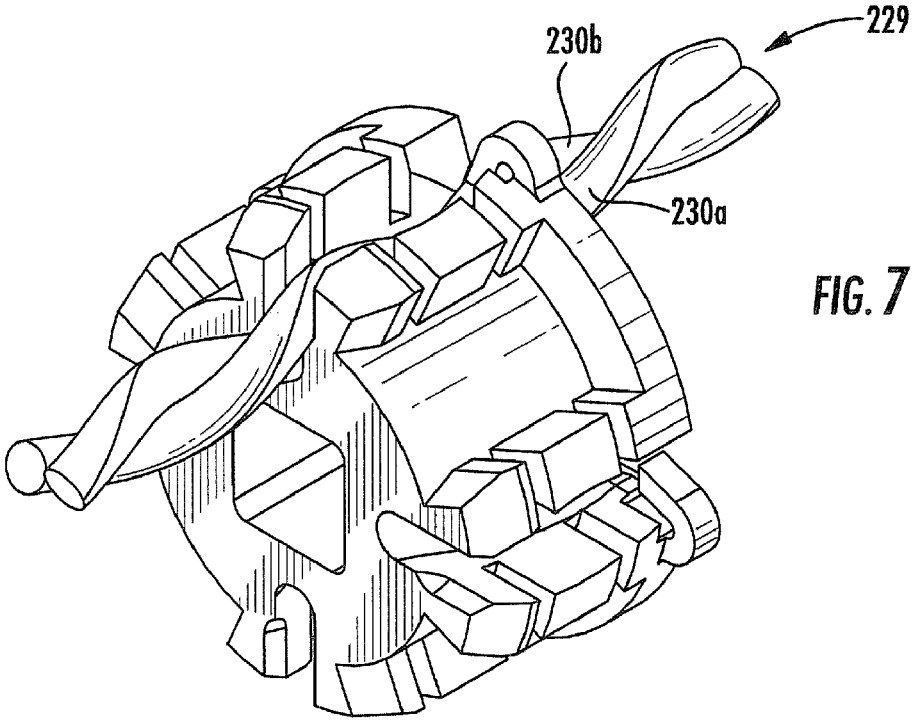
FIG. 7 is a perspective view of the device of FIG. 5 with a twisted pair of conductors in place.
Figure 8:
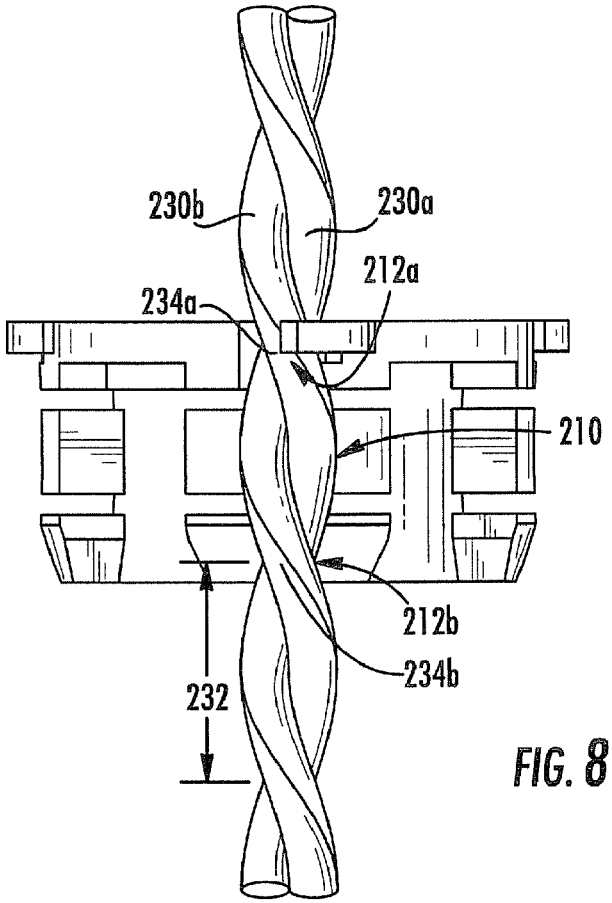
FIG. 8 is a top view of the device and twisted pair shown in FIG. 7.

Referring now to FIGS. 7 and 8, the device 200 is shown engaging a twisted pair of conductors 230*a*, 230*b* of a cable 229. The cable 229 may be a typical twisted pair cable, the construction and operation of which are well-known to those skilled in this art and need not be described in detail herein. The conductors 230*a*, 230*b* are twisted such that each twist 232 has a length of between about 0.200 and 0.220 inches. As used herein, a "twist" of a twisted pair of conductors refers to a segment of the twisted pair between crossover points; thus, looking at the twisted pair as a double helix, a "twist" would extend for approximately 180 degrees, or one-half revolution, of the conductors. The twist size or rate may vary for some or all of the twisted pairs of the cable 229. The twist 232 and channel 208 (including the indentations 209*a*, 209*b*) are sized such that the crossover points 234*a*, 234*b* of the twist 232 (in which one conductor overlies the other conductor) reside in the necked portions 212*a*, 212*b* of the channel 208. As a result, in the necked portion 212*a*, the conductor 230*b* is positioned radially outwardly from the conductor 230*a* (and therefore, at a shallower depth in the channel 208), and in the necked portion 212*b*, the conductor 230*a* is positioned radially outwardly from the conductor 230*b*. Conversely, in the expanded area 210, the conductors 230*a*, 230*b* lie generally side-by-side. The hook 214 deflects away from the channel 208 upon insertion of the conductors 230*a*, 230*b* but recovers to engage the crossing point 234*a* in order to help to maintain the conductors 230*a*, 230*b* in place in the channel 208.

Figure 4:
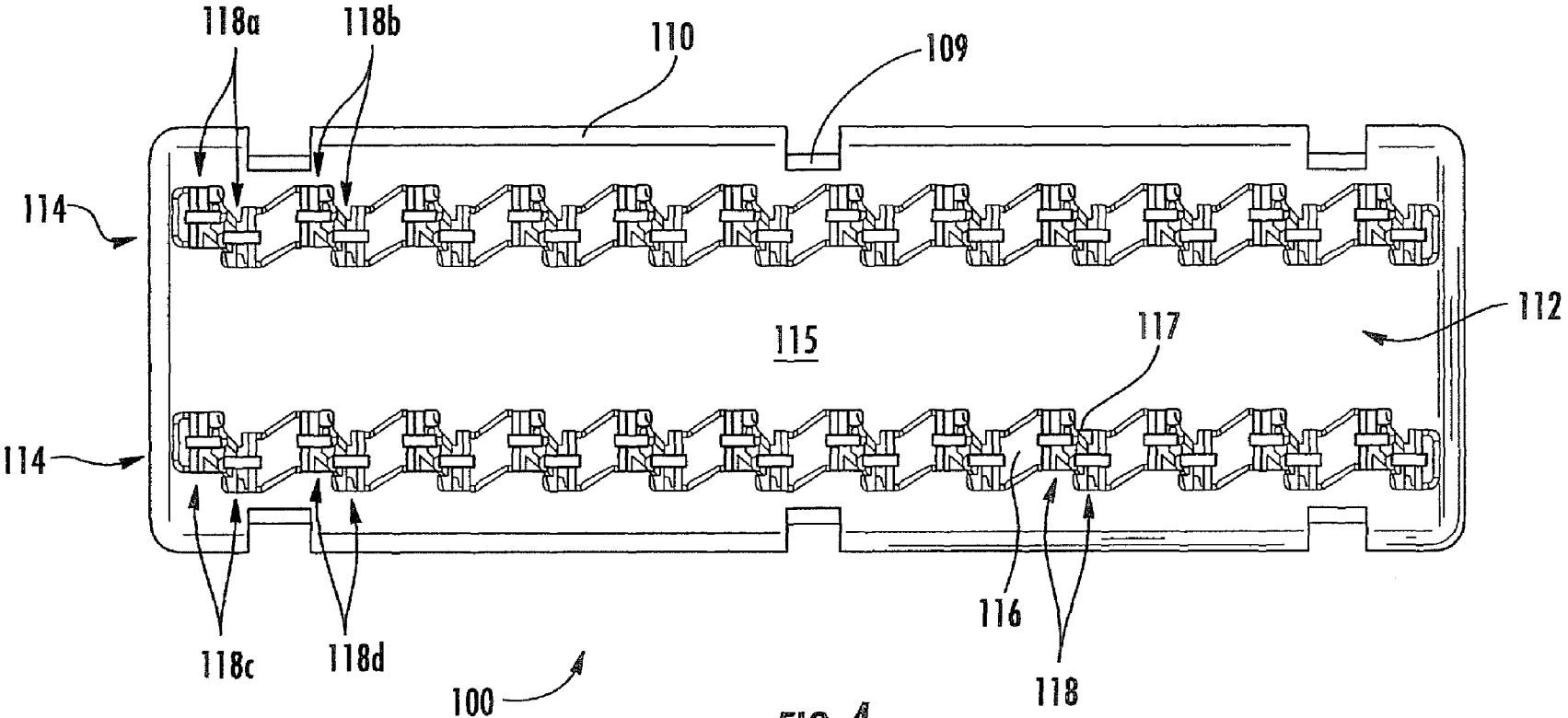
FIG. 4 (PRIOR ART)
FIG. 4 is a back view of the jack module as shown in FIG. 1.

The interconnection of the conductors 230*a*, 230*b* to mating IDCs can be understood with reference to FIGS. 9-14. Four pairs of IDC blades 240, 242 (only one pair of which is shown in FIGS. 9-14) are mounted in a housing 238 which includes an aperture 239 of sufficient size to receive the device 200. The housing 238 may be a portion of a patch panel, a jack outlet, or other device to which twisted pair conductors are typically connected. For example, the housing 238 may be the back portion 110 of the jack module 100 shown in FIGS. 1 and 4 modified to have apertures 239 and blades 240, 242. Each pair of blades 240, 242 is mounted in generally stacked, spaced apart alignment, with the four pairs being generally equally circumferentially spaced from each other, such that they extend into the aperture 239 (see FIGS. 13 and 14).

Figure 9:
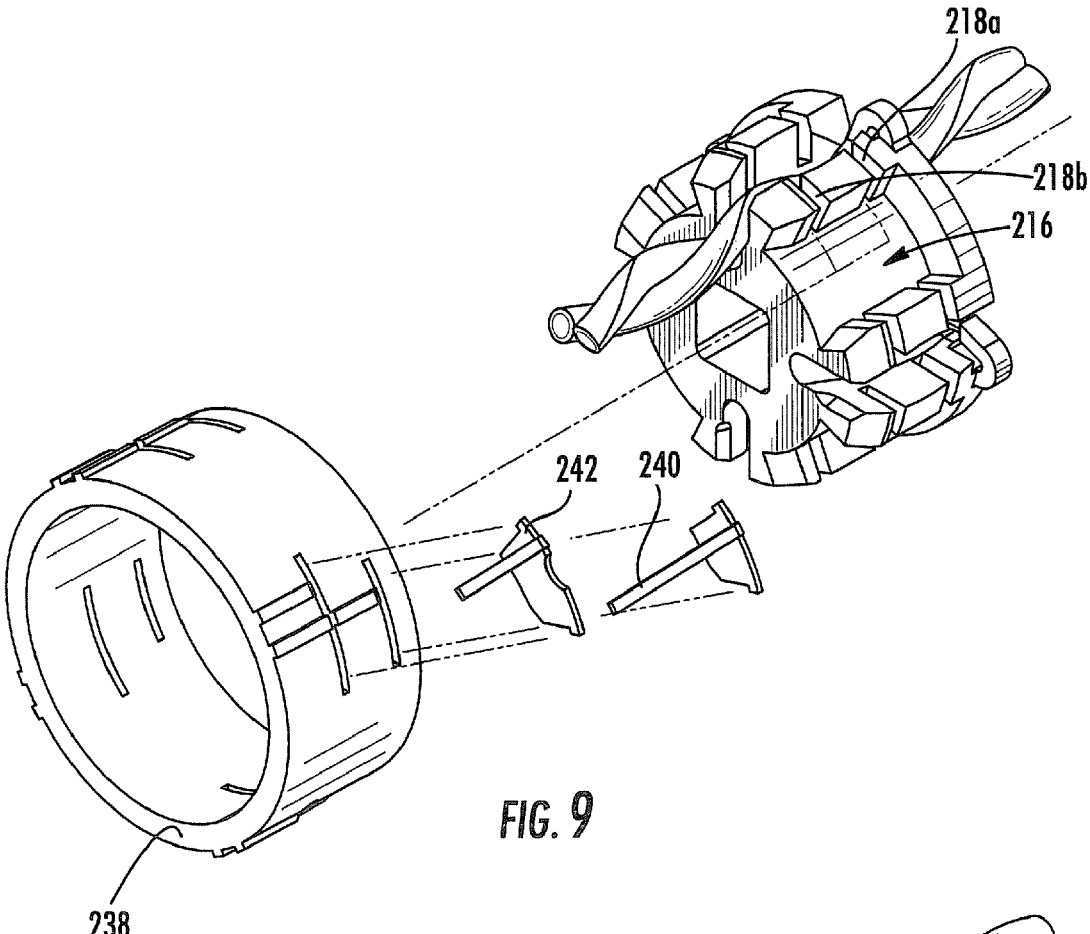
FIG. 9 is an exploded perspective view of the device and conductors of FIG. 7 and a housing with IDC blades.
Figure 10:
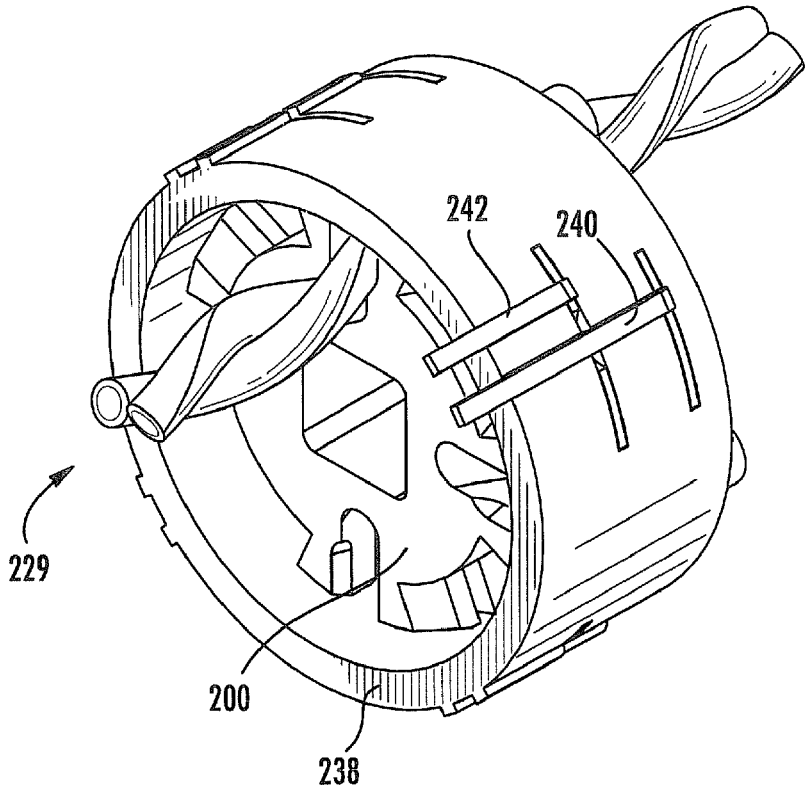
FIG. 10 is a perspective view of the device and conductors inserted into the housing of FIG. 9 prior to rotation of the device relative to the housing.
Figure 11:
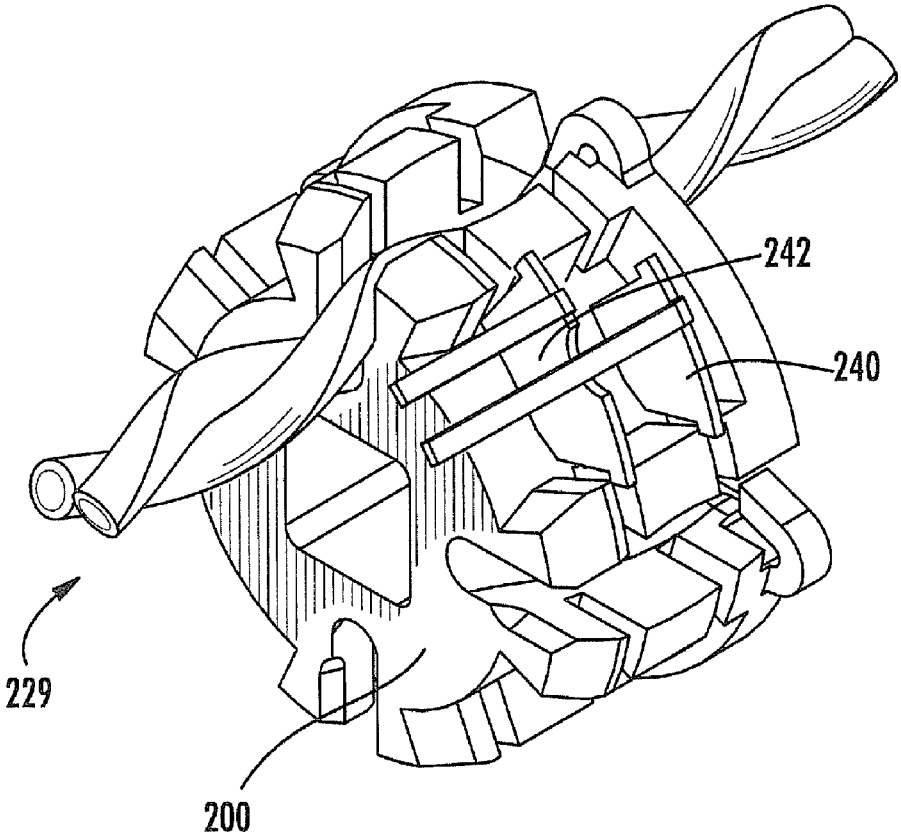
FIG. 11 is a perspective view of the device and conductors inserted into the housing as in FIG. 10, but with the housing removed for illustration of the positions of the IDC blades.
Figure 12:
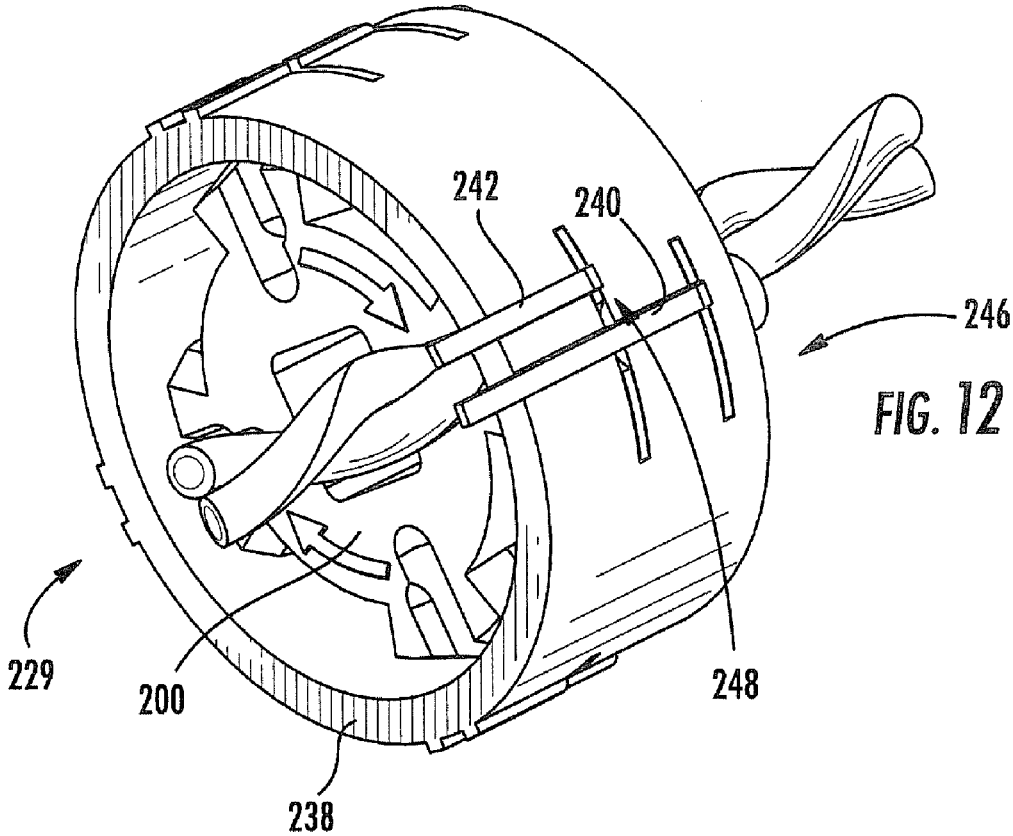
FIG. 12 is a perspective view of the device and conductors inserted into the housing and rotated into a position in which the conductors engage the IDCs.
Figure 13:
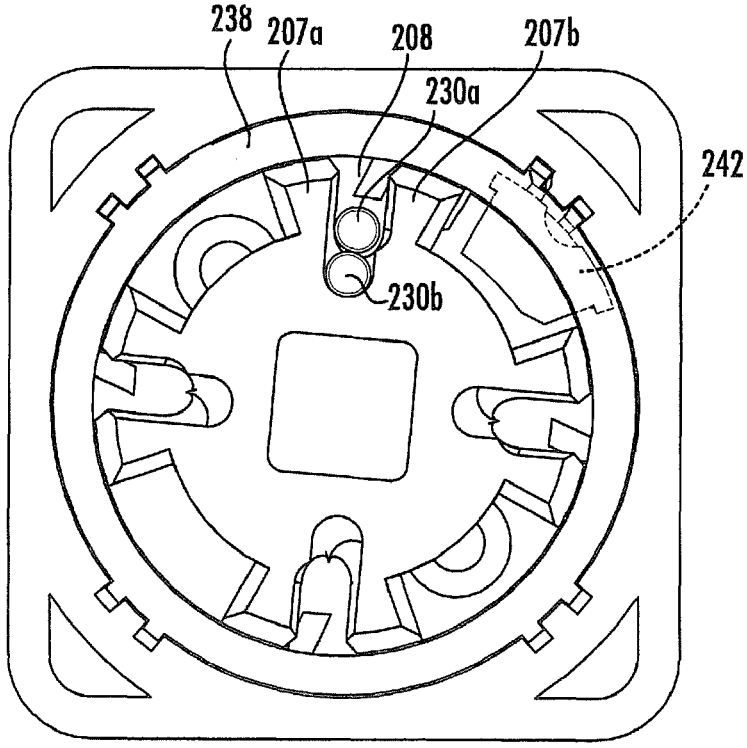
FIG. 13 is a front elevational view of the device, conductors and housing of FIG. 10, with the device inserted into the housing but not rotated into a position in which the conductors engage the IDC blades.

The device 200 is inserted into the aperture 239 by orienting the longitudinal axis A of the device 200 to be collinear with the longitudinal axis of the aperture 239 (FIG. 9). The device 200 is then pushed into the aperture 239 such that the pairs of blades 240, 242 are received in respective pockets 216 (FIGS. 10 and 11). Once the blades 240, 242 are aligned with the slots 218 in the device 200 (FIGS. 10 and 11), the device 200 is then rotated within the aperture 239 (clockwise from the vantage point of FIGS. 12-14) about its longitudinal axis until the blades 240, 242 slide into the slots 218*a*, 218*b* to engage, respectively, the conductors 230*a*, 230*b*. This rotation can be facilitated with the use of a tool, for example, a square-headed driver, that is inserted into the central bore 203 of the device 200. Upon engagement with the conductors 230*a*, 230*b*, the blades 240, 242 pierce the insulation of the conductors 230*a*, 230*b* and engage the conductive portion of the conductors at engagement locations 246, 248 (FIGS. 12 and 14).

Figure 14:
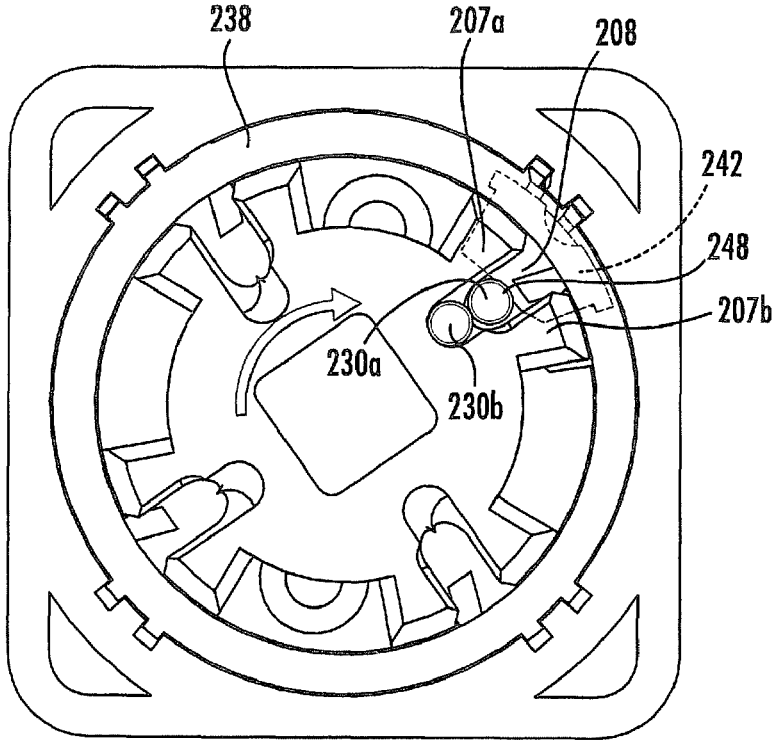
FIG. 14 is a front elevational view of the device, conductors and housing of FIG. 12, with the device inserted into the housing and rotated into a position in which the conductors engage the IDC blades.

As can be seen in FIG. 14, rotation of the device 200 causes the blades 240, 242 to engage the conductors 230*a*, 230*b*. The blades 240, 242 extend radially inwardly only a sufficient distance to engage the "top" or radially outwardly positioned conductor 230*a*, 230*b* at the respective necked portion 212*a*, 212*b*. Because the channel 208 is sized and configured to receive one twist of a pair of conductors, opposite conductors are on "top" at opposite ends of the channel 208. Thus, at the necked portion 212*a*, the blade 240 engages and makes electrical contact with the conductor 230*a* without making electrical contact with the conductor 230*b*. The reverse is true at the opposite necked portion 212*b*, where the blade 242 contacts and makes electrical contact only with the conductor 230*b* without making electrical contact with the conductor 230*a*.

The device 200 can be advantageous for multiple reasons. First, it enables the connection of one conductor of each twisted pair of conductors to one blade of a pair of IDC blades for multiple different pairs of conductors with a single movement of the device 200. Second, because each channel 208 is configured to receive a single twist of the conductors 230*a*, 230*b* and the engagement locations 246, 248 are positioned in the twist 234 (i.e., within the channel 208), the positions of these conductors are very predictable, which can assist in attempting to control the electrical properties of the conductors and the IDCs (such as crosstalk).

Those skilled in this art will recognize that the device 200 may take other forms that receive a single twist of conductors and/or permit the interconnection of multiple pairs of conductors at once within the length of the twist. For example, a square or rectangular device with two pairs of conductors retained on opposite sides may be inserted into an aperture in a housing slid sideways to engage IDCs mounted in a housing.

Alternatively, a single twist of conductors may be presented on the bottom surface of a device, and the device could be punched into IDC blades oriented and positioned to accept such twists. As another alternative, the blades of a pair of IDCs may be positioned on opposite sides of the channel that houses the twist of conductors, and the IDCs may engage the conductors in the expanded portion of the channel rather than adjacent the necked portions.

Figure 15:
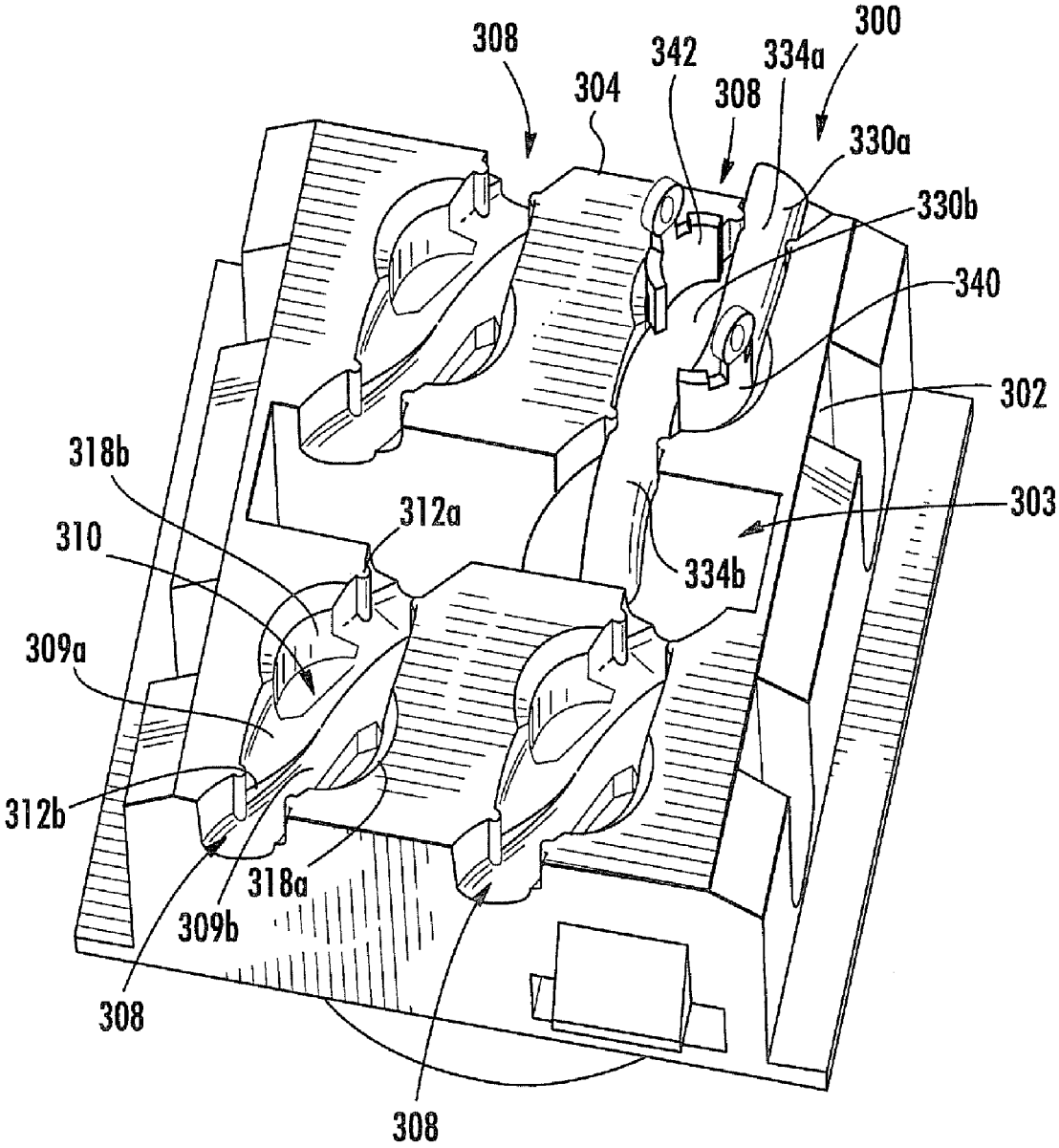
FIG. 15 is a perspective view of an alternative terminating device according to embodiments of the present invention.

An alternative embodiment of a device having these two features is illustrated in FIG. 15 and designated broadly at 300. The device 300 includes a body 302 with a lower surface 304. Four channels 308 are recessed into the bottom surface 304. Each of the channels 308 includes curved indentations 309*a*, 309*b*, which define an expanded portion 310 and necked portions 312*a*, 312*b*. Each of the channels 308 also includes indentations 318*a*, 318*b* that are configured to receive IDC blades 340, 342.

As can be seen in FIG. 15, a pair of conductors 330*a*, 330*b* is inserted through an aperture 303 and received in the upper right-hand channel 308, with each of the conductors 330*a*, 330*b* residing in a respective indentation 309*a*, 309*b*. Crossover points 334*a*, 334*b* of the conductors 330*a*, 330*b* are received in the necked portions 312*a*, 312*b*. When one or more pairs of conductors have been received in their respective channels, the device 300 can be inserted into a receiving aperture in a mating housing that includes IDC blades 340, 342. As can be seen in FIG. 15, each of the IDC blades 340, 342 engages a respective conductor 330*a*, 330*b* within the twist of the conductors.

As with the device 200, the device 300 can advantageously enable the connection of one conductor of each twisted pair conductors to one blade of a pair of IDC blades for multiple different pairs of conductors with a single movement of the device 300. Also, because each channel is configured to receive a single twist of the conductors, and the engagement locations are positioned within the twist, the positions of the conductors, and in turn the positions of the engagement locations, are very predictable, which is conducive to controlling electoral properties of the conductors and the IDCs.

As a further alternative, the guide slots 218*a*, 218*b* and/or indentations 318*a*, 318*b* may be omitted entirely, or the another IDC guide structure, such as guide pins or posts or even use of the flange 206 to register the positions of the IDC blades, may be employed. An additional embodiment may include a channel that does not taper between the expanded portion and the necked portions, but instead is generally rectangular with narrowed slots at either end.

Figure 16:
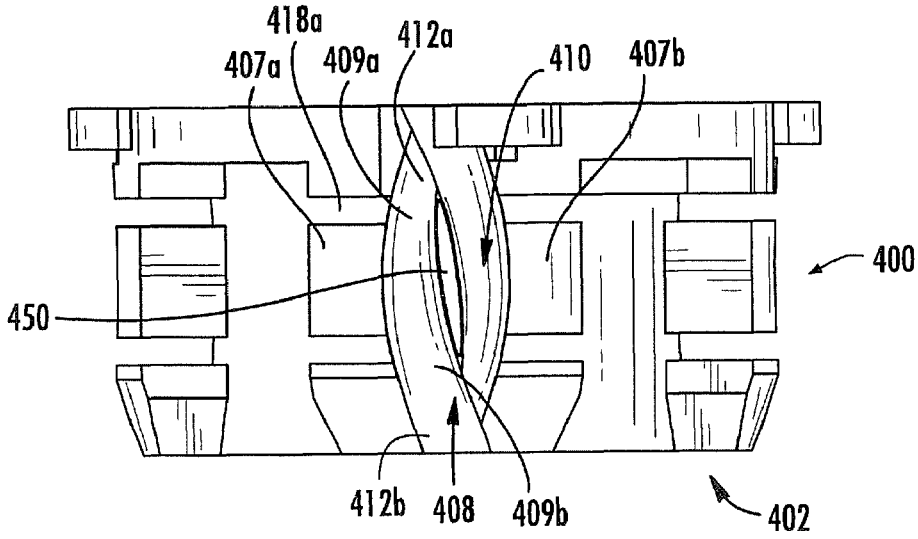
FIG. 16 is a top view of another alternative terminating device according to embodiments of the present invention.
Figure 17:
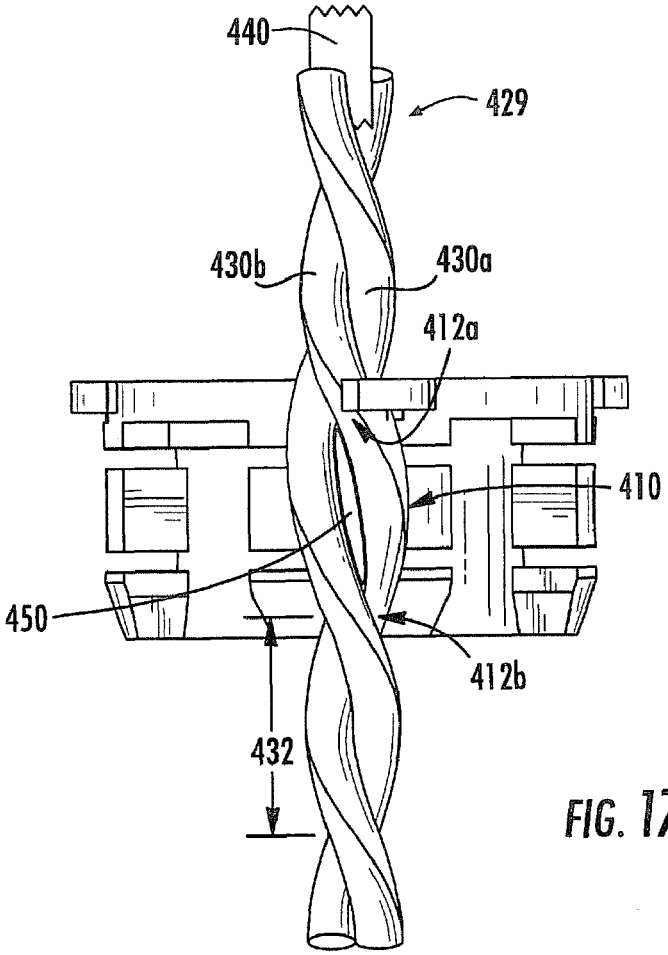
FIG. 17 is a top view of the device of FIG. 16 with a twisted pair of conductors in place.

Another embodiment of a termination device, designated broadly at 400, is illustrated in FIGS. 16 and 17. The device 400 is similar to the device 200 and includes four pairs of channel walls 407*a*, 407*b* that extend radially outwardly from the body 402. Each pair of channel walls 407*a*, 407*b* lines a respective open-ended channel 408 that extends generally parallel to the longitudinal axis of the body 402 and recedes radially inwardly into the body 402.

The channels 408 are generally spaced circumferentially equidistant from each other (i.e., in this embodiment having four channels 408, the channels 408 are spaced approximately 90 degrees from each other about the longitudinal axis of the body 402). As in the device 200, in the device 400 the channel walls 407*a*, 407*b* and the channel 408 are shaped such that at each end the channel 408 has a respective narrow necked portion 412*a*, 412*b*, and at its center the channel 408 has an expanded portion 410. Also, the floor of the channel 408 has curved indentations 409*a*, 409*b* that are arcuate in cross-section. However, the device 400 differs from the device 200 in that a splitting prong 450 is located within the channel 408 and is positioned between the indentations 409*a*, 409*b*.

Referring now to FIG. 17, the device 400 is shown engaging a twisted pair of conductors 430*a*, 430*b* of a cable 429. The cable 429 is a twisted pair cable that includes a tape 440 between pairs of conductors. The presence of the tape can make the distance between conductors 430*a*, 430*b* uniform, which in turn can result in more uniform and predictable electrical properties for the cable 429. When the conductors 430*a*, 430*b* are inserted into the channel 408, the tape 440 is removed. In order to maintain the gap between the conductors 430*a*, 430*b* that the tape 440 provides, the splitting prong 450 is received between the conductors 430*a*, 430*b* as they are inserted into the channel 408. The channel 408 maintains the twist 432 of the conductors 430*a*, 430*b* with the necked portions 412*a*, 412*b*, but also maintains the distance between the individual conductors 430*a*, 430*b* via the splitting prong 450.

Those skilled in this art will appreciate that splitting structure other than the splitting prong 450 may also be employed. For example, the splitting prong 450 may be divided into two separate projections with a gap therebetween, or may even take a comb-like configuration. Other configurations may be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

We claim:

1. An interconnection junction between a twisted pair communications cable and a communications connector having a plurality of insulation displacement contacts (IDCs), comprising:

a housing having an aperture and a pair of first and second IDCs extending within the aperture;

a twisted pair communications cable having a twisted pair of first and second conductors; and a termination device comprising:

a body having an outer surface;

a channel in the outer surface of the body, the channel being sized and configured to receive a twist of the first and second conductors and to maintain the twist in position;

IDC guide structure configured to guide the first IDC into engagement with the first conductor at a first engagement location and the second IDC into engagement with the second conductor at a second engagement location, the first and second engagement locations being positioned within the channel and within the twist of the first and second conductors;

wherein a splitting structure is positioned in the channel that separates at least a portion of the first and second conductors as they reside in the channel.

2. The interconnection junction defined in claim 1, wherein the housing is selected from the group consisting of a patch panel or a jack outlet.

3. The interconnection junction defined in claim 1, wherein the channel has a generally centrally located expanded portion and two necked portions located at respective ends of the channel.

4. The interconnection junction defined in claim 3, wherein the first and second engagement locations are positioned adjacent the necked portions.

5. The interconnection junction defined in claim 4, wherein the necked portions are sized such that first and second conductors are received therein in overlying relationship, and wherein the IDC guide structure is configured such that the first IDC engages the first conductor as the first conductor overlies the second conductor, and such that the second IDC engages the second conductor as the second conductor overlies the first conductor.

6. The interconnection junction defined in claim 1, wherein the first and second engagement locations are positioned on opposite sides of the channel.

7. The interconnection junction defined in claim 6, wherein the channel includes an expanded portion, and wherein the first and second engagement locations are positioned adjacent the expanded portion.

8. The interconnection junction defined in claim 7, wherein the splitting structure is located within the expanded portion.

9. The interconnection junction defined in claim 1, wherein the body comprises a plurality of channels, each of the channels being sized and configured to receive a twist of two conductors of a twisted pair communications cable and to maintain the twist in position.

10. The interconnection junction defined in claim 9, wherein the body is generally cylindrical, wherein the plurality of channels is four channels, and wherein the channels are generally circumferentially equidistant from each other.

11. A method of interconnecting a twisted pair communications cable with a communications connector having a pair of insulation displacement contacts (IDCs), comprising:

(a) positioning a twist of a twisted pair conductors of a communications cable in a channel in a termination device; then (b) inserting the termination device into a housing having an aperture and a pair of IDCs extending into the aperture, and (c) imparting relative movement between the termination device and the housing such that a first of the pair of IDCs engages a first conductor of the twisted pair at a first engagement location and a second of the pair of IDCs engages a second conductor of the twisted pair at a second engagement location, the first and second engagement locations being positioned within the twist of the twisted pair;

wherein a splitting structure is positioned to separate the conductors of the twisted pair within the twist.

12. The method defined in claim 11, wherein the step of imparting relative movement of the termination device and the housing comprises rotating the termination device relative to the housing.

13. An interconnection junction between a twisted pair communications cable and a communications connector having a plurality of insulation displacement contacts (IDCs), comprising:

a housing having an aperture and a pair of first and second IDCs extending within the aperture;

a twisted pair communications cable having a twisted pair of first and second conductors; and a termination device inserted into the aperture configured to receive and maintain a twist of the twisted pair;

wherein the first and second conductors engage, respectively, the first and second IDCs within the twist; and wherein the first and second conductors are separated from each other within the twist by a splitting structure.

14. The interconnection junction defined in claim 13, wherein the termination device includes a channel configured to receive and maintain the twist.

15. The interconnection junction defined in claim 14, wherein at ends of the twist the first and second conductors are in overlying relationship, wherein the first IDC engages the first conductor as the first conductor overlies the second conductor, and wherein the second IDC engages the second conductor as the second conductor overlies the first conductor.

16. The interconnection junction defined in claim 14, wherein the first and second engagement locations are positioned on opposite sides of the channel.

17. The interconnection junction defined in claim 16, wherein the channel includes an expanded portion, and wherein the first and second engagement locations are positioned adjacent the expanded portion.

18. The interconnection junction defined in claim 17, wherein the splitting structure is located within the expanded portion.

19. A method of connecting the conductors of a twisted pair communications cable having a twisted pair of first and second conductors with a termination device that includes first and second members and a plurality of insulation displacement contacts (IDCs), the method comprising:

(a) positioning each conductor on the first member of the termination device; and (b) rotating one of the first and second members relative to the other of the first and second members to cause each IDC to engage and make electrical contact with a respective one of the conductors within a twist of the first and second conductors, wherein a splitting structure separates the first and second conductors as they reside within the twist.

* * * * *